US008282427B2

(12) United States Patent
Yamazaki

(10) Patent No.: US 8,282,427 B2
(45) Date of Patent: Oct. 9, 2012

(54) CONNECTOR

(75) Inventor: Tomohiro Yamazaki, Saitama (JP)

(73) Assignees: Furukawa Electric Co., Ltd., Tokyo (JP); Furukawa Automotive Systems, Inc., Shiga-Ken (JP)

( * ) Notice: Subject to any disclaimer, the term of this patent is extended or adjusted under 35 U.S.C. 154(b) by 280 days.

(21) Appl. No.: 12/599,630

(22) PCT Filed: May 13, 2008

(86) PCT No.: PCT/JP2008/058772

§ 371 (c)(1),
(2), (4) Date: Jan. 26, 2010

(87) PCT Pub. No.: WO2008/140082

PCT Pub. Date: Nov. 20, 2008

(65) Prior Publication Data

US 2010/0136853 A1 Jun. 3, 2010

(30) Foreign Application Priority Data

May 15, 2007 (JP) ..... 2007-128873

(51) Int. Cl.
*H01R 13/514* (2006.01)

(52) U.S. Cl. ..... 439/752; 439/595

(58) Field of Classification Search ..... 439/752, 439/595
See application file for complete search history.

(56) References Cited

U.S. PATENT DOCUMENTS 5,108,319 A * 4/1992 Tsuji et al. ..... 439/752
5,350,320 A * 9/1994 Hashizawa et al. ..... 439/752
5,484,223 A * 1/1996 Saito ..... 403/329

FOREIGN PATENT DOCUMENTS

JP 3-106669 U 11/1991
JP 6-58569 U 8/1994
JP 8-321344 A 12/1996

OTHER PUBLICATIONS

English Language International Search Report dated Jun. 10, 2008 issued in Appln. No. PCT/JP2008/058772.

* cited by examiner

*Primary Examiner* — Xuong Chung Trans
(74) *Attorney, Agent, or Firm* — Holtz, Holtz, Goodman & Chick, PC

(57) ABSTRACT

The stable temporarily locked state of a housing and a rear holder is kept. When the rear holder is positioned at its temporarily locked position, the front claw of the locking part for temporary locking of the rear holder slips under the locking piece for temporary locking of the housing, and holds the locking piece in cooperation with the rear claw. The temporarily locked state cannot be easily lost.

8 Claims, 7 Drawing Sheets

CONNECTOR

This application is a U.S. National Phase Application under 35 USC 371 of International Application PCT/JP2008/058772 filed May 13, 2008.

TECHNICAL FIELD

The present invention relates to a connector including a rear holder for retaining connecting terminals installed within a housing into locked condition. Such a connector has been used in an electric wiring circuit in an automobile.

TECHNICAL BACKGROUND

In an electric connector of the kind mentioned above is described, for instance in a Patent Document 1. In this known connector, a rear holder is detachably provided at a rear portion of a housing, said rear holder being driven into a temporarily engaged position in which the rear holder is halfway inserted into the housing as well as into a finally engaged position in which the rear holder is fully inserted into the housing. If the rear holder is fit into the housing after all the necessary connecting terminals have been installed within the housing, it is necessary to pass electric wires having one ends connected to respective connecting terminals through the rear holder. It is apparent that this assembling operation is very cumbersome. Contrary to this, the assembling operation could be performed efficiently by inserting the connecting terminals and electric wires connected to the connecting terminals are inserted into the housing through the rear holder positioned at the temporarily engaged position.

It has been also known to provide locking lances for locking the connecting terminals installed within the housing at the rear holder which is separately provided from the housing. In such a connector, the locking lances could be formed by molding and the connector could be less expensive, because the locking lances which has to be made of an expensive material having a relatively high durability could be provided in the rear holder having a small size or volume.

Patent Document 1: Japanese Patent Laid-open Kokai Hei 8-321344

DISCLOSURE OF THE INVENTION

Problems to be solved by the Invention

When the above mentioned known electrical connectors are delivered to harness makers, the rear holders are halfway inserted into the housings up to the temporarily engaged position, and operators of the harness makers insert the connecting terminals into given positions within the housing through the rear holders.

However, during the transportation of the connectors, the rear holders might be accidentally inserted into the housings up to the finally engaged position. Then, the operators have to remove the rear holders from the finally engaged position to the temporarily engaged position, and this operation is quite cumbersome.

The present invention has for its object to provide an electrical connector, in which the above mentioned problems can be solved and the rear holder can be stably remained in the temporarily engaged position in which the rear holder is halfway inserted into the housing.

Means for Solving the Problems

In order to attain the above mentioned object, according to the invention, a connector comprises a housing within which connecting terminals are to be installed, and a rear holder which is inserted into said housing from a rear end of the housing into a finally engaged position through a temporarily engaged position and includes locking lancers for locking said connecting terminals in position, characterized in that said rear holder includes a temporary engagement locking portion and a final engagement locking portion, said temporary engagement locking portion has a front claw and a rear claw which are separated from each other viewed in an inserting direction of the rear holder, and that said rear holder is locked at the temporarily engaged position by clamping a strip-like temporary engagement locking portion provided on the housing by said front and rear claws.

Merits of the Invention

In the connector according to the invention, the rear holder is locked at the temporarily engaged position by means of the temporary engagement locking portion and could not freely move in the inserting direction with respect to the housing to keep the temporarily engagement state.

EXPLANATION OF REFERENCE NUMERALS

Figure 1:
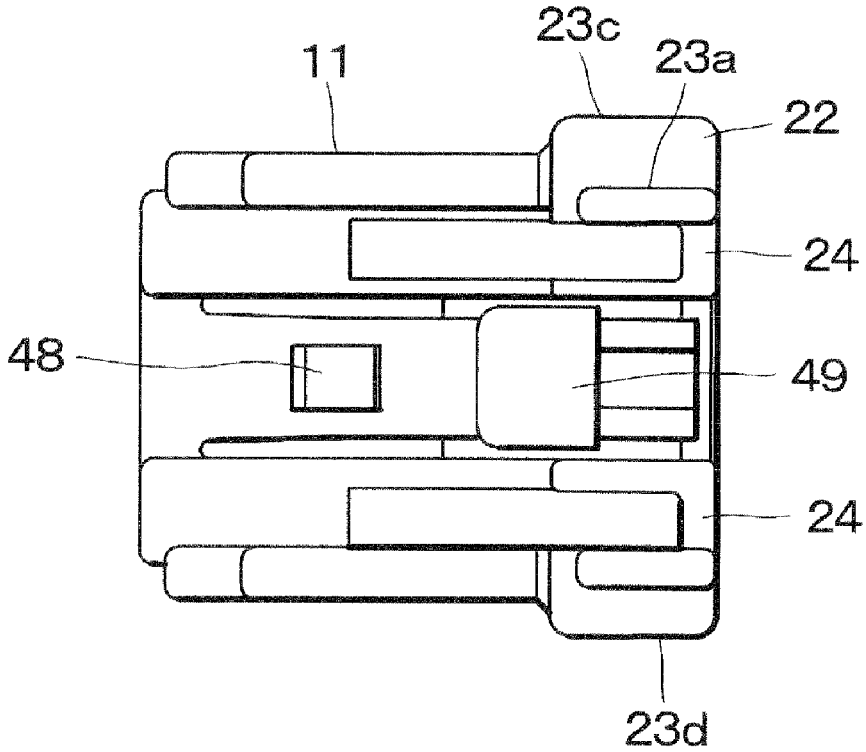
FIG. 1 is a plan view showing a housing of an embodiment of the electrical connector according to the invention.

11 housing
12 rear holder
13 connecting terminal
21 connecting terminal accommodating room
22 rear holder accommodating room
23 wall portion
24 temporary engagement locking ridge
25 final engagement locking ridge
41 holder main body
42 locking lance
44 temporary engagement locking claw
45 front claw

46 rear claw
47 final engagement locking claw

BEST MODE OF THE INVENTION

Figure 2:
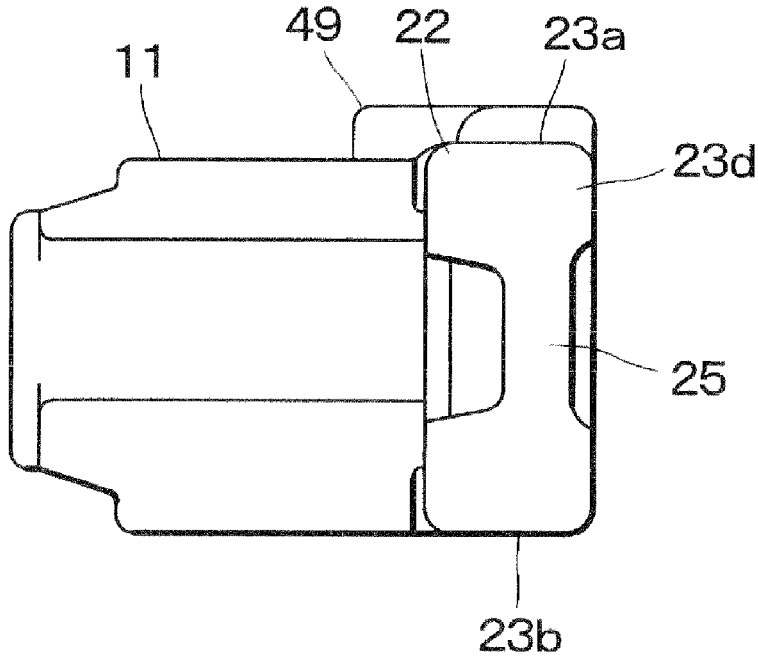
FIG. 2 is a side view of the housing.
Figure 3:
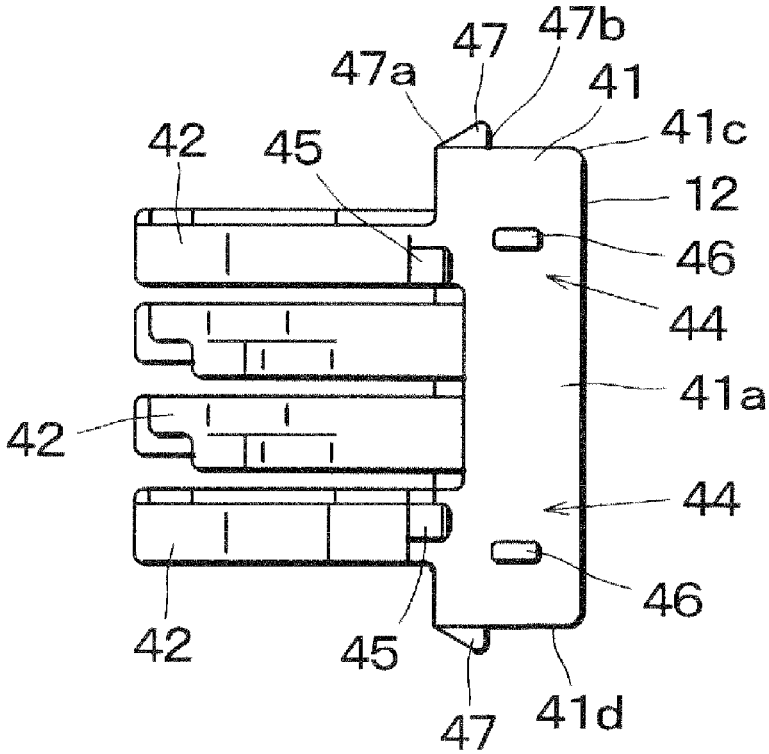
FIG. 3 is a plan view illustrating a rear holder.
Figure 4:
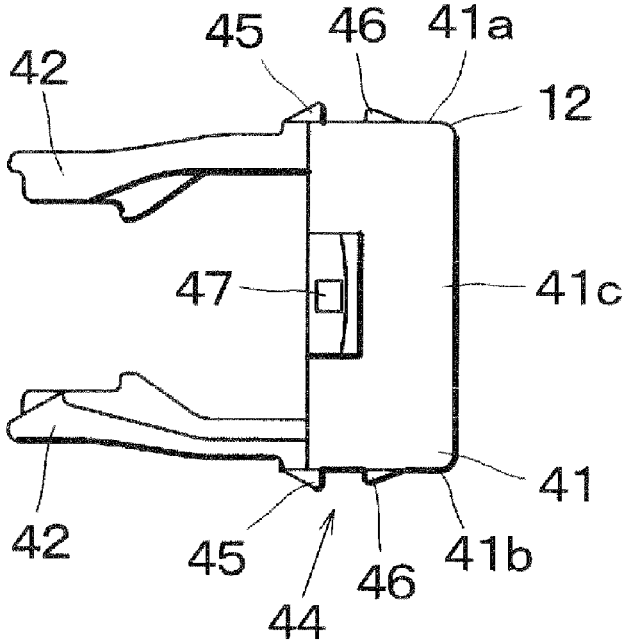
FIG. 4 is a side view of the rear holder.
Figure 5:
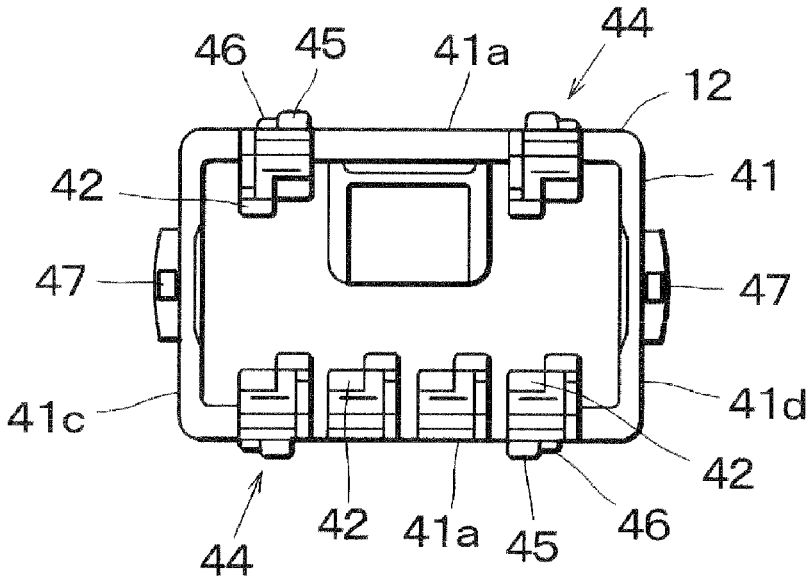
FIG. 5 is a front view of the rear holder.

The present invention will be explained in detail with reference to the embodiment shown in the drawings. FIGS. 1 and 2 are a plan view and a side view, respectively showing a housing and FIGS. 3, 4 and 5 are a plan view, a side view and a front view, respectively illustrating a rear holder. The housing 11 is formed to install therein a plurality of connecting terminals and the rear holder 12 is inserted into the housing from a rear portion of the housing and is engaged with the housing such that the connecting terminals installed within the housing are not removed from the housing.

Figure 6:
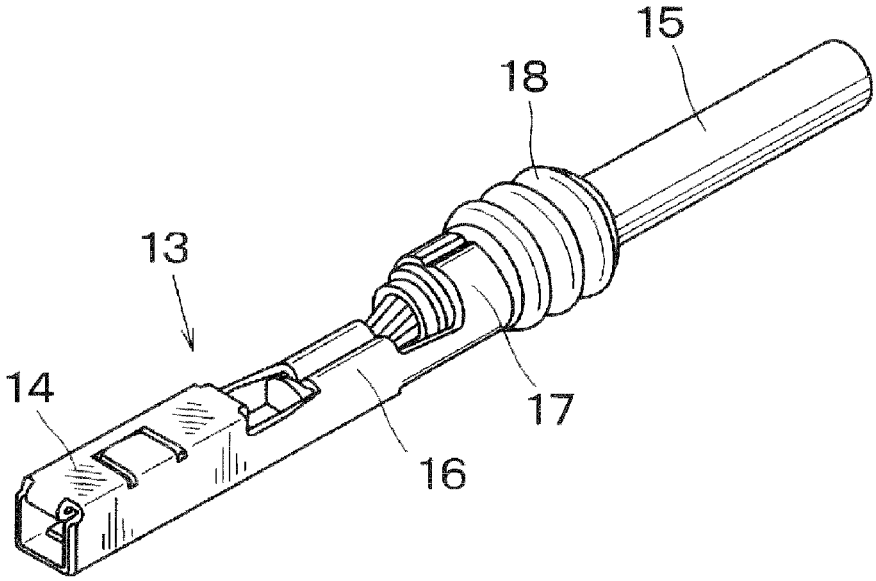
FIG. 6 is a perspective view depicting a connecting terminal.

A connecting terminal 13 shown in FIG. 6 is accommodated within the housing 11. The connecting terminal 13 is formed by folding an electrically conductive metal plate. A terminal connecting portion 14 of a rectangular cylindrical shape to be connected to a cooperating terminal, a mandrel fixing portion 16 for fixing a core conductor of an electric wire 15 and a sheath fixing portion 17 for fixing an outer sheath of the electric wire 15 are successively provided in the connecting terminal 13 viewed in a front and rear direction. At a rear of the sheath fixing portion 17 there may be provided a waterproof sealing member 18.

The housing 11 and rear holder 12 are formed by molding an electrically insulating synthetic resin. The housing 11 is generally formed into a substantially rectangular cylindrical shape, and has formed therein six connecting terminal accommodating rooms 21 for accommodating the connecting terminals 13 independently from one another, two connecting terminal accommodating rooms being formed along an upper row and four connecting terminal accommodating rooms being provided along a lower row. It should be noted that sections and internal structure of the connecting terminal accommodating rooms 21 are not shown in the drawings.

At a rear end portion of the housing 11 there is formed a rear holder accommodating portion 22 having a size larger than a size of a remaining portion. On upper and lower walls 23*a* and 23*b* of the rear holder accommodating portion 22, there are formed strip-like temporary engagement locking ridges 24, two ridges 24 being formed on each of the upper and lower walls separately from each other viewed in a direction perpendicular to the inserting direction of the rear holder 12. On each of right and left walls 23*c* and 23*d* there is formed a final engagement locking ridges 25 extending in a direction perpendicular to the inserting direction of the rear holder 12.

The rear holder 12 has formed therein a rectangular cylindrical shape holder main body 41 which is to be engaged with the rear holder accommodating portion 22 provided at the rear end of the housing 11. On a front side of the holder main body 41, there are protruded six locking lances 42 each serving to lock the terminal connecting portion 14 of respective connecting terminals 13 accommodated in the connecting terminal accommodating rooms 21 of the housing 11. In a rear wall of the holder main body 41 there are formed five openings, not shown in the figures, through which the connecting terminals 13 having the electric wires 15 connected thereto may be inserted into the housing 11.

On each of upper and lower walls 41*a* and 41*b* of the holder main body 41, there are formed two temporary engagement locking portions 44 which cooperate with the temporary engagement locking ridges 24 formed on the housing 11. Each of the temporary engagement locking portions 44 includes a pair of front claw 45 and a rear claw 46 which are separated in the rear holder inserting direction. It should be noted that in the present embodiment, the front and rear claws 45 and 46 are also separated in a direction perpendicular to the rear holder inserting direction in relation to the molding. A space between the front and rear claws 45 and 46 in the rear holder inserting direction is set such that the temporary engagement locking ridge 24 of the housing 11 is clamped between the front and rear claws.

A front side of the front claw 45 is inclined to gradually ascend toward the rear claw 46 and a rear side of the front claw 45 is shaped to form an upright wall. A height of the rear claw 46 is smaller than that of the front claw 45 and a front side of the rear claw 46 is formed into an upright wall and a rear side of the rear claw 46 descends toward the rear wall of the rear holder 12. It should be noted that a corner between the front and rear sides of the rear claw 46 is somewhat rounded off such that the rear holder can be easily inserted into the final engaged position without being interrupted by the rear claw 46.

On each of right and left walls 41*c* ad 41*d* of the holder main body 41 of the rear holder 12, there is formed a final engagement locking claw 47 which is engaged with the final engagement locking ridge 25 of the housing 11. A front side of the final engagement locking claw 47 is inclined to gradually ascend toward the rear portion and a rear side of the final engagement locking claw 47 is shaped to form an upright wall.

The final engagement locking ridge 25 of the housing 11 has an inner surface opposing to the rear holder 12, said inner surface being inclined by an angle identical with an inclined angle of the inclined surface 47*a* of the final engagement locking claw 47 of the rear holder 12. It should be noted that the housing 11 further includes a locking lever provided on a top surface of the housing and a locking claw 48 is provided on the locking lever, said locking claw is to be engaged with a cooperating housing. Upon releasing the locked condition, a push portion 49 formed on the locking lever is pushed downward, and then the locking claw 48 is unlocked from the cooperating housing.

Figure 7:
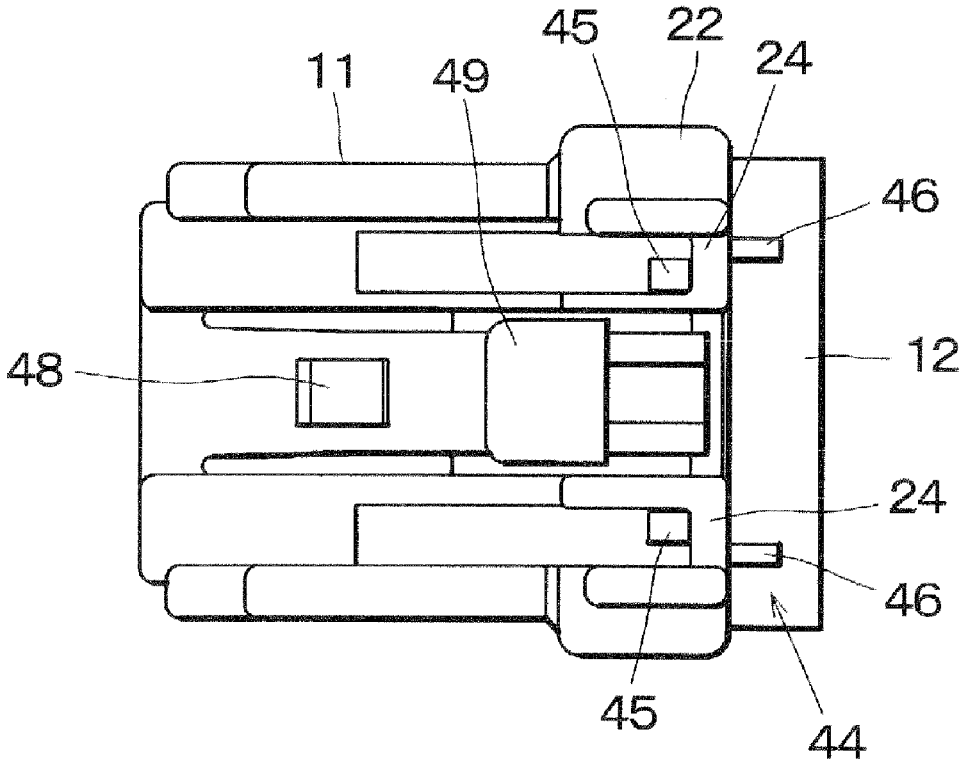
FIG. 7 is a plan view showing the housing and rear holder in a temporarily engaged position.
Figure 8:
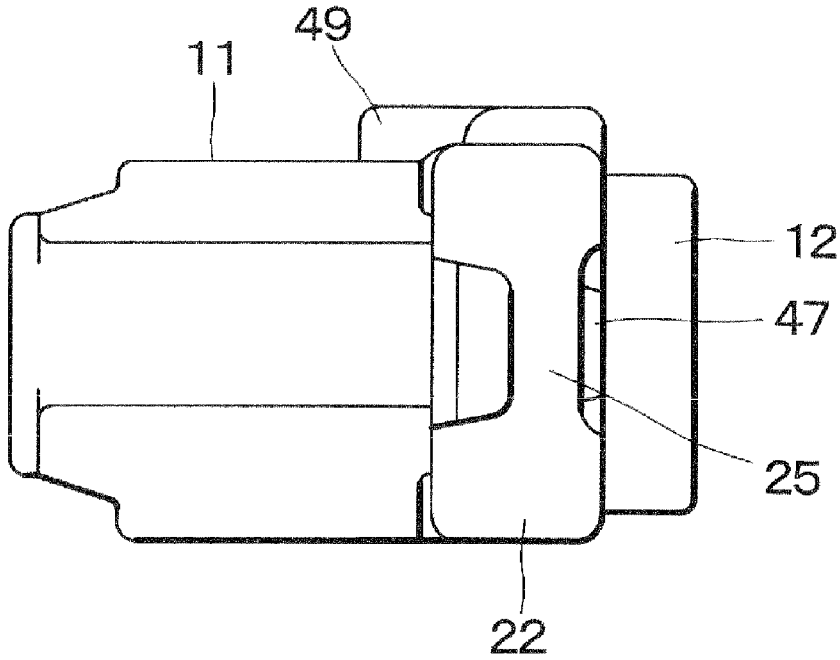
FIG. 8 is a side view depicting the housing and rear holder in the temporarily engaged position.
Figure 9:
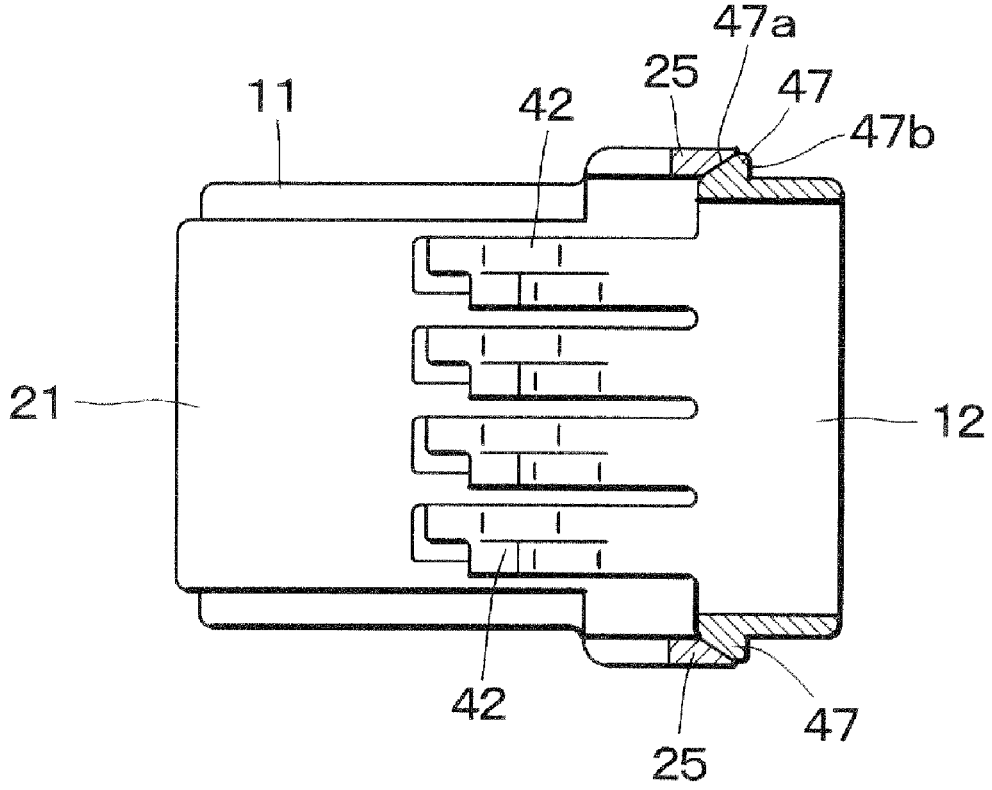
FIG. 9 is a cross sectional view showing the housing and rear holder in the temporarily engaged position cut along a horizontal plane.
Figure 10:
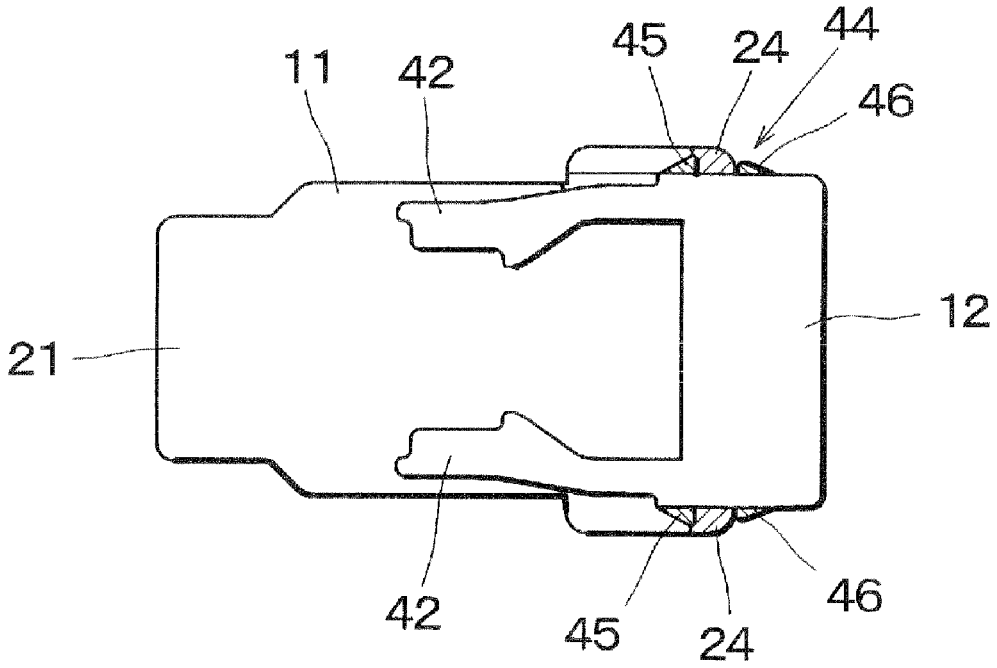
FIG. 10 is a cross sectional view illustrating the housing and rear holder in the temporarily engaged position cut along a vertical plane.
Figure 11:
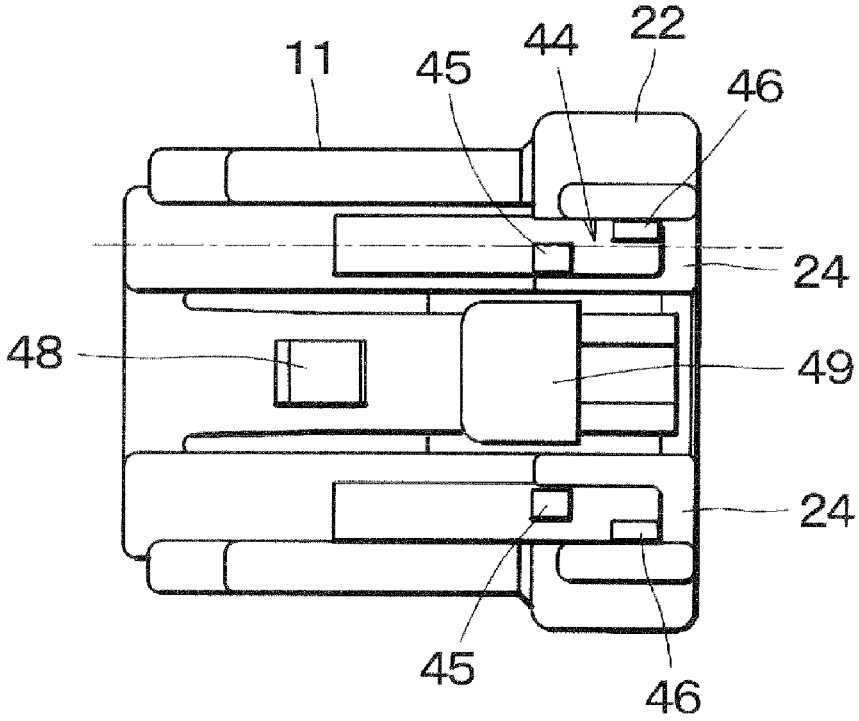
FIG. 11 is a plan view showing the housing and rear holder in a finally engaged position.
Figure 12:
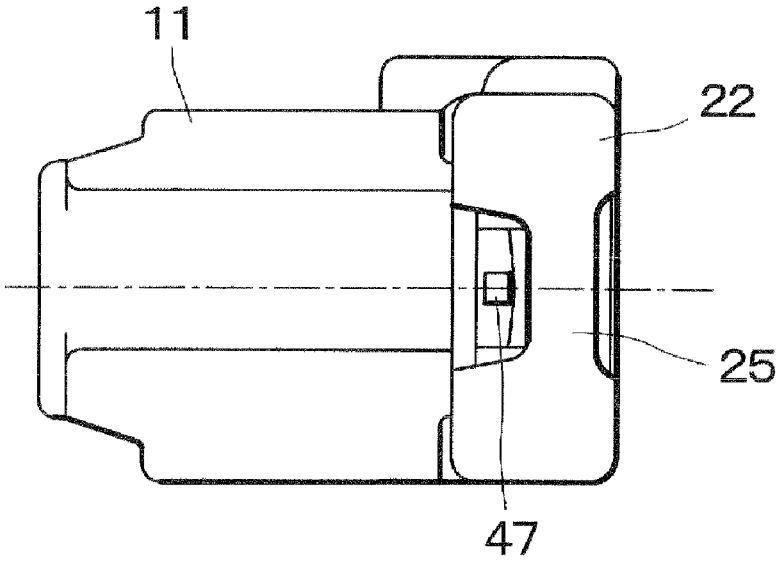
FIG. 12 is a side view illustrating the housing and rear holder in the finally engaged position.
Figure 13:
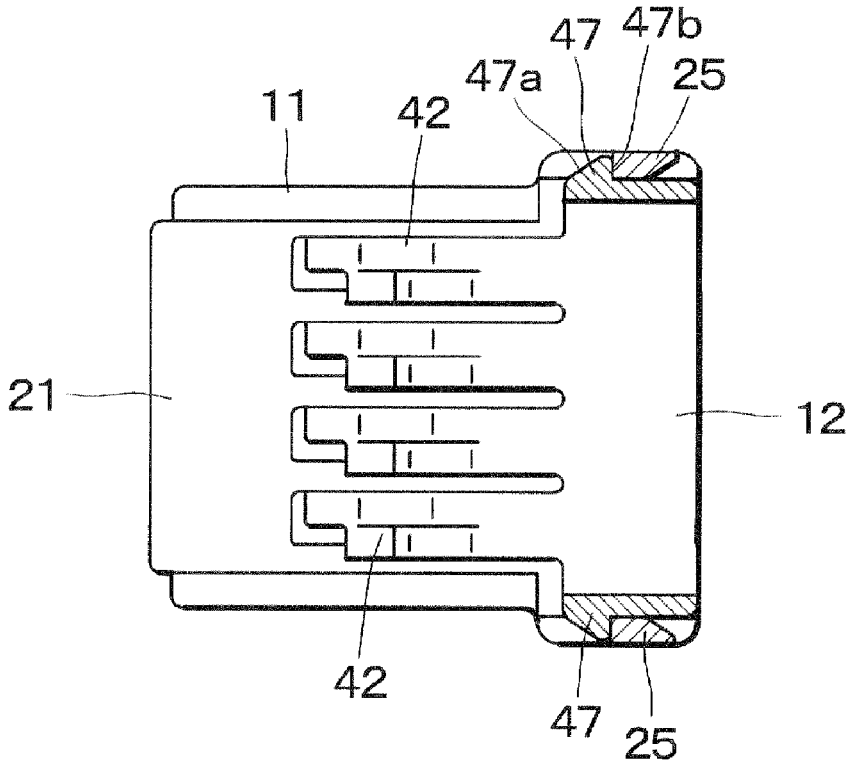
FIG. 13 is across sectional view depicting the housing and rear holder in the finally engaged position cut along a horizontal plane.
Figure 14:
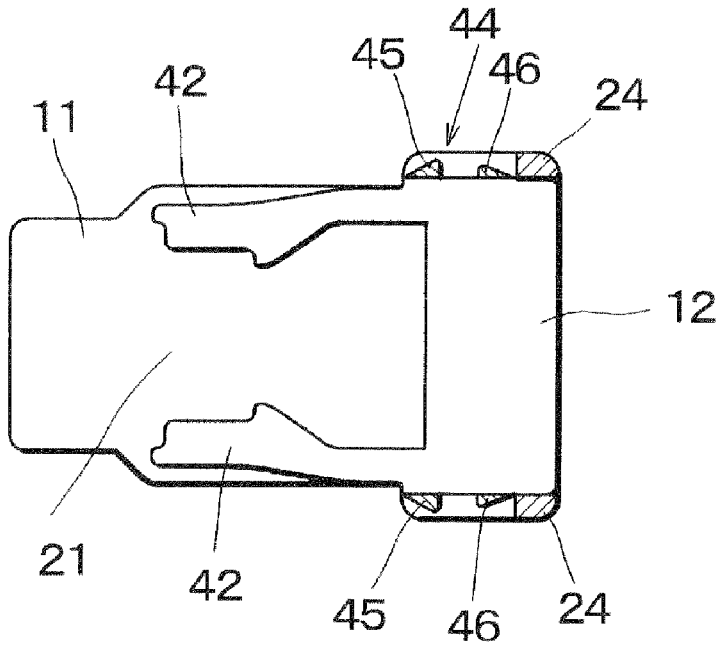
FIG. 14 is a cross sectional view showing the housing and rear holder in the finally engaged position cut along a vertical plane.

The housing 11 and rear holder 12 having the structure so far explained are engaged with each other at the temporarily engaged position in which the rear holder 12 is halfway inserted into the housing 11 as illustrated in FIGS. 7-10 and at the finally engaged position in which the rear holder 12 is fully inserted into the housing 11 as shown in FIGS. 11-14. FIGS. 7 and 11 are plan views, FIGS. 8 and 12 are side views, FIGS. 9 and 13 are cross sectional views cut along a horizontal plane, and FIGS. 10 and 14 are cross sectional views cut along a vertical plane.

In the temporarily engaged position depicted in FIGS. 7-10, the front claw 45 of the temporary engagement locking portion 44 of the rear holder 12 has passed through the temporary engagement locking ridge 24 of the housing 11 such that the temporary engagement locking ridge 24 of the housing 11 is sandwiched between the front rear claws 45 and 46. In this condition, the inclined surface 47*a* of the final engagement locking 47 of the rear holder 12 is urged against the inclined inner surface of the final engagement locking ridge 25.

In the temporarily engaged position, the temporary engagement locking ridges 24 of the housing 11 are clamped between the front and rear claws 45 and 46 of the temporary engagement locking portions 44 of the rear holder 12 and at the same time, the final engagement locking claws 47 of the rear holder 12 are urged against the final engagement locking ridge 25 of the housing 11. Therefore, the rear holder 12 could not be easily inserted into the housing 11 and the temporarily engaged condition could be remained during the transportation of the connector.

Upon assembling the harness, the connecting terminals 13 having the electric wires 15 connected thereto are inserted into the housing 11 toward respective terminal accommodating rooms 21 of the housing 11 through the openings from in the rear wall of the rear holder 12. Upon insertion of the connecting terminal 13, the terminal connecting portion 14 of the connecting terminal 13 is brought into contact with the locking lance 42 and the locking lance is bent outside. After the terminal connecting portion 14 of the connecting terminal 13 has passed though the locking lance 42, the locking lance 42 is bent back toward the original position and is engaged with a rear end of the terminal connecting portion 14. It should be noted that in the temporarily engaged position, the connecting terminals 13 are not fully inserted into the terminal accommodating rooms 21 of the housing 11, but are inserted into temporarily inserted positions.

After all the connecting terminals have been inserted into the temporarily inserted positions of the terminal accommodating rooms 21, the rear holder 12 is further inserted into the housing 11 with a strong force. Then, the rear claws 46 of the temporary engagement locking portion 44 of the rear holder 12 are inserted forwardly beyond the temporary engagement locking ridges 24 of the housing 11 and at the same time, the final engagement locking claws 47 of the rear holder 12 are forcedly moved in the forward direction beyond the final engagement locking ridge 25 of the housing 11. In this manner, the rear holder 12 is completely inserted into the rear holder accommodating portion 22 of the housing 11, and the rear holder 12 is remained in the finally engaged position shown in FIGS. 11-14 by the engagement of the final engagement locking claw 47 with the final engagement locking ridge 25 of the housing 11.

During the insertion of the rear holder 12 into the housing 11, the connecting terminals 13 are pushed forwardly by the locking lances 42 of the rear holder 12 and are inserted into final positions within the terminal accommodating rooms 21 and are remained therein by means of the locking lances 42.

What is claimed is:

1. A connector comprising:

a housing within which connecting terminals are to be installed, and a rear holder which is inserted into said housing from a rear end of the housing into a finally engaged position through a temporarily engaged position and which includes locking lances for locking said connecting terminals in position, wherein said rear holder further includes a plurality of temporary engagement locking portions and a plurality of final engagement locking portions, each said temporary engagement locking portion including a front claw and a rear claw which are separated from each other in an inserting direction of the rear holder and in a direction perpendicular to the inserting direction, wherein a pair of said front and rear claws is formed on each of upper and lower walls of said rear holder, and each of said final engagement locking portions is provided on each of right and left sidewalls of said rear holder, wherein, in the temporarily engaged position, front and rear portions of temporary engagement locking ridges provided on said housing are clamped between said front and rear claws, and inclined surfaces of said final engagement locking portions are urged against rear portions of final engagement locking ridges of said housing, and wherein, at the finally engaged position, said final engagement locking portions are engaged with said final engagement locking ridges.

2. The connector according to claim 1, wherein said front claw has an inclined front side and an upright rear side.

3. The connector according to claim 1, wherein a height of the rear claw is smaller than a height of the front claw.

4. The connector according to claim 3, wherein a corner between front and rear sides of said rear claw is rounded off such that the rear holder can be easily inserted into the finally engaged position.

5. The connector according to claim 4, wherein at the finally engaged position, the rear claws are inserted forwardly beyond the temporary engagement locking ridges provided on said housing.

6. The connector according to claim 1, wherein the rear holder includes four sets of the temporary engagement locking portions and two the final engagement locking portions.

7. The connector according to claim 1, wherein inner surfaces of the rear portions of the final engagement locking ridges of the housing are inclined by an angle that is identical with an inclined angle of the inclined surfaces of the final engagement locking portions.

8. The connector according to claim 1, wherein each final engagement locking portion comprises a final engagement locking claw having an inclined front side and an upright rear side.

* * * * *